United States Patent [19]

Brenner et al.

[11] Patent Number: 4,555,919

[45] Date of Patent: Dec. 3, 1985

[54] FLEXIBLE VANE AGITATOR FOR HIGH STROKE RATE AUTOMATIC WASHER

[75] Inventors: Robert A. Brenner; Robert B. Sherer, both of St. Joseph Township, Berrien County, Mich.

[73] Assignee: Whirlpool Corporation, Benton Harbor, Mich.

[21] Appl. No.: 663,361

[22] Filed: Oct. 22, 1984

[51] Int. Cl.[4] ..... D06F 17/10

[52] U.S. Cl. ..... 68/134

[58] Field of Search ..... 68/131–134; 366/276, 278

[56] References Cited

U.S. PATENT DOCUMENTS

| | | | |
|---|---|---|---|
| 1,619,637 | 3/1924 | Schroeder | 68/134 |
| 1,745,177 | 3/1927 | Markley | 68/134 |
| 2,619,827 | 12/1952 | Castricone | 68/133 |
| 2,688,241 | 9/1954 | Stevenson | 68/134 |
| 2,823,534 | 2/1958 | Loehle | 68/134 X |
| 3,112,632 | 12/1963 | Walton | 68/54 |
| 3,296,840 | 1/1967 | Tichenor | 68/134 |
| 3,307,383 | 3/1967 | Cobb et al. | 68/134 |
| 3,381,504 | 5/1968 | Smith | 68/134 X |
| 3,651,672 | 3/1972 | Salisbury | 68/134 |
| 3,736,775 | 6/1973 | Smith | 68/23 R |

FOREIGN PATENT DOCUMENTS

| | | | |
|---|---|---|---|
| 11331 | 2/1934 | Australia | 68/134 |

*Primary Examiner*—Philip R. Coe

*Attorney, Agent, or Firm*—Hill, Van Santen, Steadman & Simpson

[57] ABSTRACT

A flexible vane agitator is provided for use with a high stroke rate automatic washing machine in which the vanes on the agitator are very flexible and have a special configuration in which the thickness of the vanes decreases from a base end at the agitator barrel to a point at least half way to the end of the vane and then increases in thickness to the radial tip such that the tip is bulbous and is thicker than any other portion of the vane except for the base. The bulbous tip is rounded and has a shorter height than the base end.

18 Claims, 5 Drawing Figures

FIG. 3
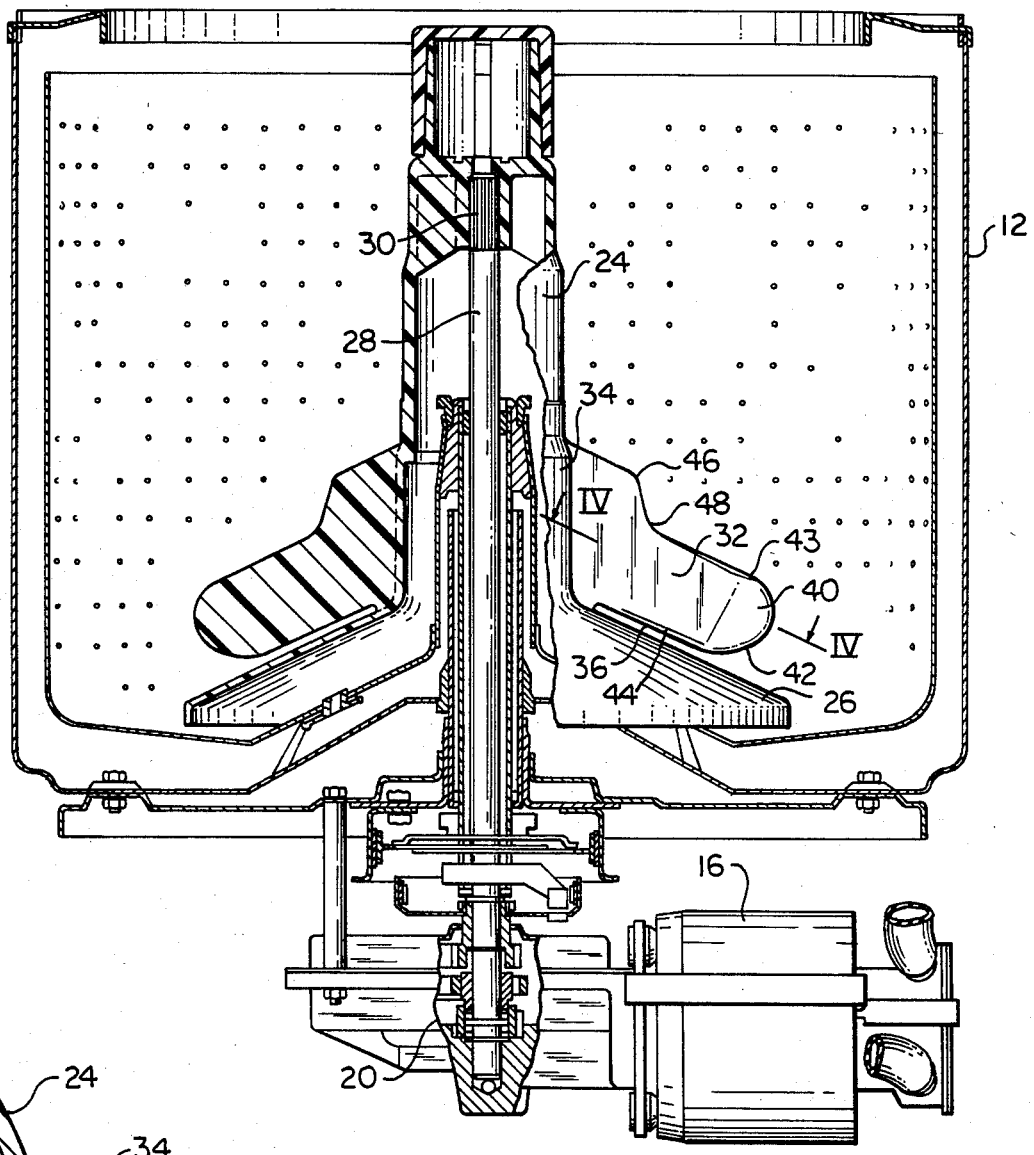
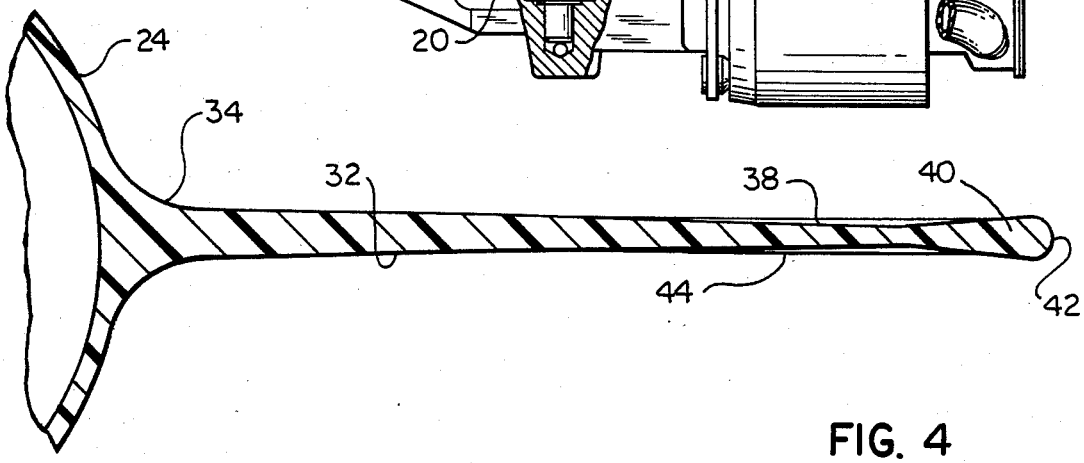
FIG. 4

FLEXIBLE VANE AGITATOR FOR HIGH STROKE RATE AUTOMATIC WASHER

BACKGROUND OF THE INVENTION

1. Field of the Invention

The present invention relates to an improved agitator structure which is particularly adapted for use in automatic washers which provide short stroke, high stroke rate agitation.

2. Description of the Prior Art

Most conventional automatic washers provide agitation at relatively low stroke rates, with a long agitator stroke. By way of an example, a conventional washer manufactured by Whirlpool Corporation provides an agitator stroke length of 198° at a stroke rate of 68 oscillations per minute. In contrast, a high stroke rate washer may have a stroke rate of 180 oscillations per minute with a stroke length of 100°.

Some conventional washers use an agitator having vanes which flex during agitation of the clothes load. For instance, such agitators are described in U.S. Pat. Nos. 3,296,840 and 3,307,383, both assigned to Whirlpool Corporation. Such agitators have been found to provide very good overall washing performance. Good washing performance requires that a careful balance be struck between the sometimes competing considerations of washability, fabric abrasion, and lint generation. In developing an agitator for a high stroke rate, low stroke angle washer, the applicants found that a flexible vane agitator suitable for conventional machines provided less than desirable performance.

In particular, use of a conventional flexible vane agitator in a high stroke rate washer was found to produce undesirable levels of fabric abrasion and lint generation. Thinning the vane material to increase the amount of vane flexure was found to reduce the lint generation but, very surprisingly, provided a higher level of fabric abrasion. It was also found that, using the conventional agitator material such as polypropylene, providing an agitator with extremely flexible vanes in a further attempt to reduce fabric abrasion would shorten the useful life of the agitator due to vane breakage.

SUMMARY OF THE INVENTION

The present invention employs agitator vanes which are more flexible than the vanes found on conventional flexible vane agitators but which are not so flexible as to result in vane breakage. A central feature of the present invention is the use of an enlarged, or bulbous vane tip, which has been found to overcome the problem of excess fabric abrasion occurring when agitators with very flexible vanes are used in high stroke rate washers. Only the tip portion of the blade has been enlarged because enlarging the entire periphery of the vane would reduce the flexing action of the vane to an undesirable degree.

In the illustrated embodiment, the improved vane of the present invention is thicker at its base, tapers to a minimum thickness in a radially outwardly direction to a predetermined point more than half way along the length of the vane, and then increases gradually to form a bulbous tip having a thickness which is substantially greater than the thickness of the main portion of the blade. The improved agitator is provided with five flexible vanes, all having the same configuration. Further, it has been found that the bulbous tip vane works successfully with a "stepped" vane which has an abrupt height change along its length as well as a gradually tapering vane.

BRIEF DESCRIPTION OF THE DRAWINGS

FIG. 3 is a side partial sectional view of the agitator taken generally along the lines III—III of FIG. 2.

FIG. 4 is a sectional view of a vane taken generally along the lines IV—IV of FIG. 3.

DESCRIPTION OF THE PREFERRED EMBODIMENTS

Figure 1:
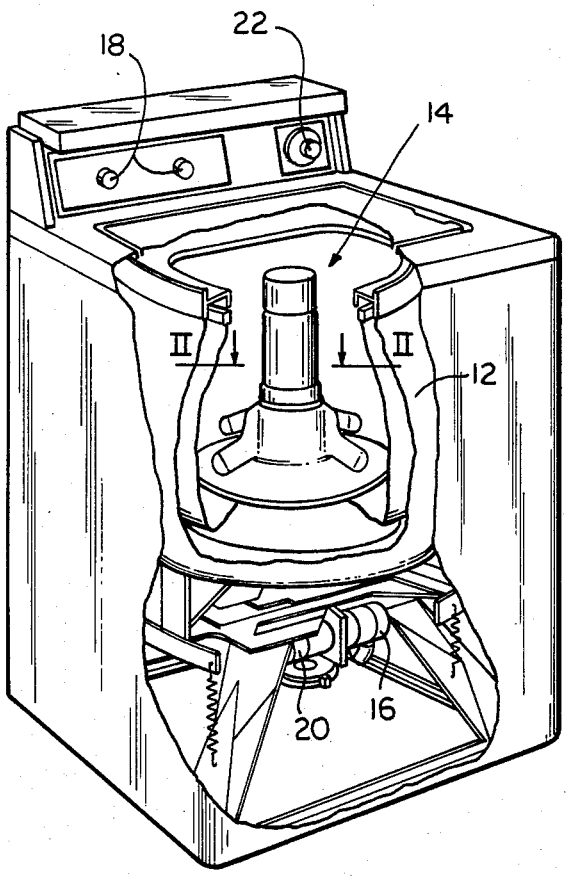
FIG. 1 is a perspective view of an automatic washer with an agitator embodying the principles of the present invention.

In FIG. 1, a washing machine is generally shown at 10 as having a tub 12 with a vertical agitator 14 therein, an electrically driven motor 16 operably connected via a transmission 20 to the agitator 14 and controls 18 including a presettable sequential control means 22 for use in selectively operating the washing machine 10 through a program sequence of washing, rinsing and extracting steps.

The agitator 14 is seen in greater detail in FIG. 3 where it is seen that the agitator 14 is comprised of a vertical barrel portion 24 rising from a sloped skirt portion 26 within the center of the tub 12. A drive shaft 28 has a splined connection 30 to the agitator barrel 24 to drivingly oscillate the agitator 14 within the tub 12. A washing machine for which the present invention is particularly suitable is a high stroke rate washer which would oscillate the agitator at a rate of approximately 180 oscillations per minute with a stroke length of approximately 100°.

Figure 2:
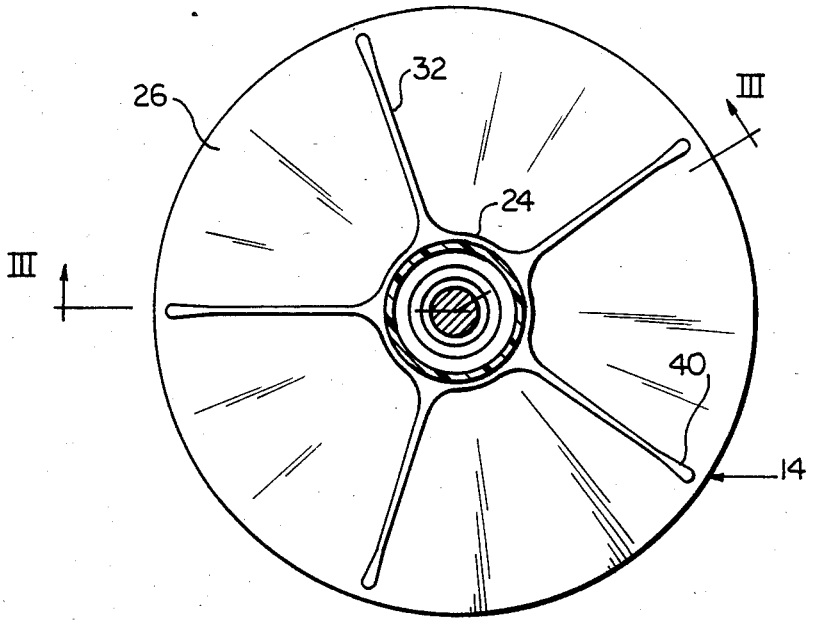
FIG. 2 is a top sectional view taken generally along the lines II—II of FIG. 1.

Just above the skirt portion 26 of the agitator 14 are a plurality of angularly spaced, radially projecting flexible vanes 32. As seen in FIG. 2, there are five vanes 32 which project radially outwardly from the barrel portion 24 of the agitator 14 above the skirt portion 26.

The vanes 32 are attached at a radially inward base end 34 along the entire height of the vane which comprises the sole means of attachment of the vane to the agitator. As seen best in FIG. 3, a bottom edge 36 of the vane 32 is spaced above the skirt 26 thereby allowing the vane 32 to flex about the base.

Of critical importance to this invention is the radial cross section of the vane 32 which is shown in detail in FIG. 4. It is seen that the vane 32 decreases in thickness from the base 34 in a radially outwardly direction to a point 38 which is located more than half way along the blade length, from which point 38 the vane thickness increases gradually to form a bulbous tip 40 having a rounded outer periphery 42 and a thickness which is greater than all but the base portion 34 of the vane 32. The thickness at the tip 40 should be at least twice as thick at the thin point 38. The vane 32 does have a small bead 43 along a portion of its top edge and a small bead 44 along a portion of its bottom edge, but those beads, which act to strengthen the vanes, are not as thick as the bulbous tip 40.

Figure 5:
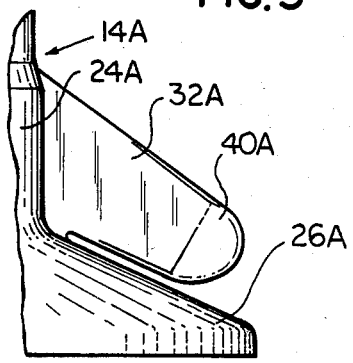
FIG. 5 is a partial elevational view of an alternate vane configuration.

The vane configuration shown in FIG. 3 is a "stepped" vane configuration in that there is an abrupt height change between points 46 and 48. The improved agitator embodying the principles of the present invention has also been found to work equally well in a vane configuration which has a gradual taper such as seen in the alternate embodiment of the vane 32A of FIG. 5. The agitator vane is constructed virtually identical to that shown in FIG. 3 with the exception of the configuration of the top edge of the vane. A radial cross section of the two vanes is identical and the view of FIG. 4 accurately represents the radial cross section through the vane of FIG. 5.

It is thus seen that an agitator is provided which has a flexible vane including an enlarged portion along its radial tip and wherein the vane decreases in thickness from its base to a predetermined point which is located more than half way along the vane length, from which point the vane thickness increases gradually to form a bulbous tip having a rounded outer periphery in a thickness which is greater than all but the base portion of the vane.

An agitator with such vanes has been determined to provide improved overall washing performance as compared with prior flexible vane agitators for use in high stroke rate, low stroke angle automatic washers. In particular, lint generation and fabric abrasion are reduced while maintaining good washability. The agitator is very simple and economical to manufacture, using conventional materials and molding processes. Further, the agitator provides sufficient vane flexibility to achieve good rollover of the clothes load during agitation, but is not so thin or soft as to result in an unacceptable level of vane breakage during use.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

Having described the invention, the embodiments of the invention in which an exclusive property or privilege is claimed are defined as follows:

1. For use in a high stroke rate automatic washer, a vertically mounted oscillating agitator comprising:

an upstanding barrel portion;

a flared skirt portion joined to a bottom end of said barrel portion;

a plurality of flexible vanes connected at their base to said barrel portion and extending radially outwardly from said barrel portion and spaced above said skirt portion;

said vanes having a strengthening rib along at least a portion of a top and bottom edge of said vanes and a bulbous radial tip portion, the thickness of said tip portion being greater than the thickness at any other portion of the vane, including said ribs, except for said base.

2. For use in a high stroke rate automatic washer, a vertically mounted oscillating agitator comprising:

an upstanding barrel portion;

a flared skirt portion joined to a bottom end of said barrel portion, a plurality of vanes connected at their base to said barrel portion and extending radially outwardly from said barrel portion and spaced above said skirt portion;

said vanes having a decreasing thickness radially outwardly from said base to a point more than half way along their length and an increasing thickness from said point radially outwardly to a radial tip, the thickness at said tip being greater than the thickness at any other place along the vane except for the base.

3. The device of claim 2 wherein each of said vanes has a stepped profile with a relatively tall base end and a shorter tip end.

4. The device of claim 2 wherein each of said vanes has a relatively tall base and the height of said vane gradually decreases to said tip.

5. The device of claim 2 wherein said tip of said vane has a rounded contour.

6. The device of claim 2 wherein said tip is at least twice as thick as said point.

7. The device of claim 2 wherein five of said vanes are provided on said agitator.

8. A vane configuration for use on a vertical axis washing machine agitator comprising:

a base end connected to said agitator;

a radial tip at an opposite end of said vane; and a thickness decreasing from said base end radially outwardly to a point more than half way along the length of said vane and an increasing thickness from said point radially outwardly to said tip, the thickness at said tip being greater than the thickness at any other point along said vane except at said base.

9. The device of claim 8 wherein said radial tip is shorter in height than said base end.

10. The device of claim 9 wherein said vane has a stepped profile.

11. The device of claim 9 wherein said vane has a sloping vertical profile.

12. The device of claim 8 wherein said tip of said vane has a rounded contour.

13. The device of claim 8 wherein said tip is at twice as thick as said point.

14. The device of claim 8 wherein said vane is mounted vertically on said agitator.

15. For use in a high stroke rate automatic washer, a vertically mounted oscillating agitator comprising:

an upstanding barrel portion;

a flared skirt portion joined to a bottom end of said barrel portion;

a plurality of vertically oriented flexible vanes connected at their base to said barrel portion and extending radially outwardly from said barrel portion and spaced above said skirt portion;

said vanes having a configuration comprising:

a relatively tall base end connected to said agitator, a shorter radial tip at an opposite end of said vane, a rounded contour at said tip, a thickness decreasing from said base ends to a point more than half way along the length of said vane and an increasing thickness from said point radially outwardly to said tip, the thickness at said tip being greater than the thickness at any other place along said vane except at said base and said tip thickness being at least twice as great as the thickness at said point.

16. The device of claim 15 wherein each of said vanes has a stepped profile.

17. The device of claim 15 wherein each of said vanes has a tapered vertical profile.

18. The device of claim 15 wherein five vanes are provided on said agitator.

* * * * *

UNITED STATES PATENT AND TRADEMARK OFFICE

CERTIFICATE OF CORRECTION

PATENT NO. : 4,555,919

DATED : December 3, 1985

INVENTOR(S) : Robert A. Brenner and Robert B. Sherer

It is certified that error appears in the above—identified patent and that said Letters Patent is hereby corrected as shown below:

Column 4, line 36, claim 13, after the word "at" add —least—.

Signed and Sealed this

*First* Day of *July 1986*

[SEAL]

*Attest:*

DONALD J. QUIGG

*Attesting Officer*

*Commissioner of Patents and Trademarks*